United States Patent [19]

Parkinson

[11] Patent Number: 4,521,162

[45] Date of Patent: Jun. 4, 1985

[54] PUMPING SYSTEM

[75] Inventor: Francis J. Parkinson, Warrington, England

[73] Assignee: British Nuclear Fuels plc, Warrington, England

[21] Appl. No.: 607,448

[22] Filed: May 7, 1984

[30] Foreign Application Priority Data

May 24, 1983 [GB] United Kingdom ..... 8314320

[51] Int. Cl.[3] ..... F04F 1/02; F04F 1/14; F04B 23/14

[52] U.S. Cl. ..... 417/138; 417/149; 417/86; 417/87

[58] Field of Search ..... 417/86, 87, 138, 145, 417/149

[56] References Cited

U.S. PATENT DOCUMENTS 640,023 12/1889 Perkins ..... 417/86
2,669,941 2/1954 Stafford ..... 417/138 X
3,991,825 11/1976 Morgan ..... 417/138 X

FOREIGN PATENT DOCUMENTS 1480484 7/1977 United Kingdom .

*Primary Examiner*—Richard E. Gluck
*Attorney, Agent, or Firm*—William R. Hinds

[57] ABSTRACT

A fluidic pumping system comprises a reverse flow diverter positioned below the level of a liquid to be pumped and inserted between a charge vessel and a delivery pipe. Control means including signal generating means, conveniently an ultrasonic transducer, effect alternate pressurizing and venting of the charge vessel for pumping the liquid. A pipe for the supply of compressed air to the charge vessel serves as a waveguide for the signals from the signal generating means.

4 Claims, 5 Drawing Figures

PUMPING SYSTEM

The present invention concerns pumping systems incorporating fluidic devices.

BACKGROUND OF THE INVENTION

Pumping systems incorporating fluidic devices are attractive for pumping hazardous liquids as the fluidic devices do not include moving parts which could require repair or replacement with consequent risk to maintenance personnel. One known pumping system incorporates a fluidic device known as a reverse flow diverter RFD. An RFD comprises two opposed nozzles separated by a gap which opens into or communicates with the liquid which is to be pumped and examples of RFD's and their manner of operation are given in British patent specification No 1480484.

The present invention seeks to provide pumping systems incorporating fluidic devices and having improved means of control.

FEATURES AND ASPECTS OF THE INVENTION

According to the present invention a pumping system comprises a vessel for a liquid to be pumped, a reverse flow diverter positioned at a level below the level of liquid to be pumped and inserted between a charge vessel and a delivery pipe, compressed air supply means for the charge vessel and control means for effecting alternate pressurising and venting of the charge vessel to effect pumping of the liquid, in which the control means comprises a duct leading to the charge vessel and means for generating signals along the duct for detecting the liquid level at at least one position in the operating cycle.

DESCRIPTION OF THE DRAWINGS

The invention will be described further, by way of example, with reference to the accompnaying drawings; in which.

DESCRIPTION OF PREFERRED EMBODIMENTS

Figure 1:
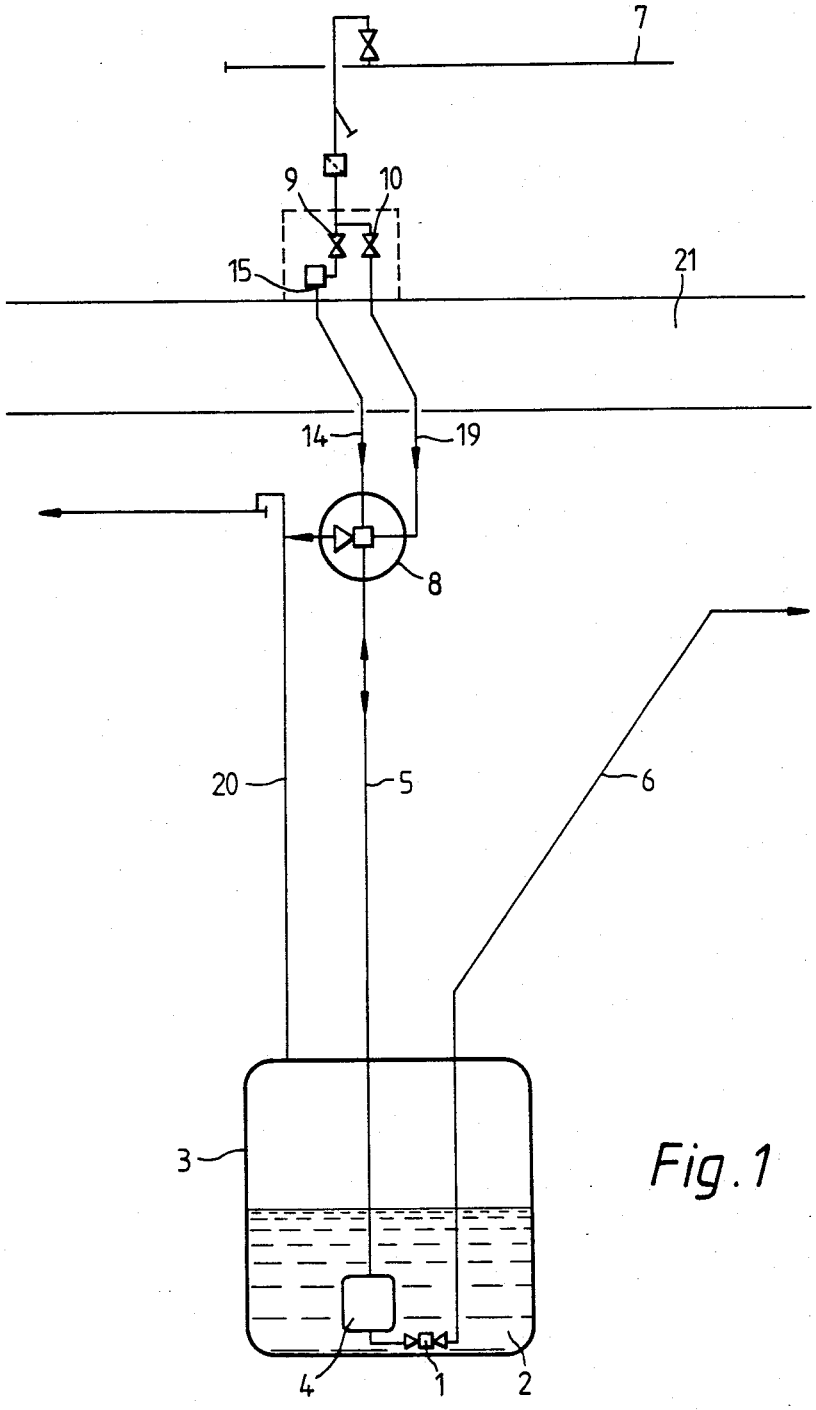
FIG. 1 is a schematic arrangement of a pumping system according to the invention.

In FIG. 1, RFD 1 is immersed in a liquid 2 contained within a vessel 3. The RFD comprises two opposed, co-axial conical nozzles separated by a gap which opens into the liquid 2. One nozzle is connected to a charge vessel 4 having air link pipe 5. The other nozzle of the RFD is connected to a delivery pipe 6 for the liquid. The pipe 5 communicates with a compressed air supply line 7 by way of a primary controller 8 and solenoid valves 9 and 10.

Figure 2:
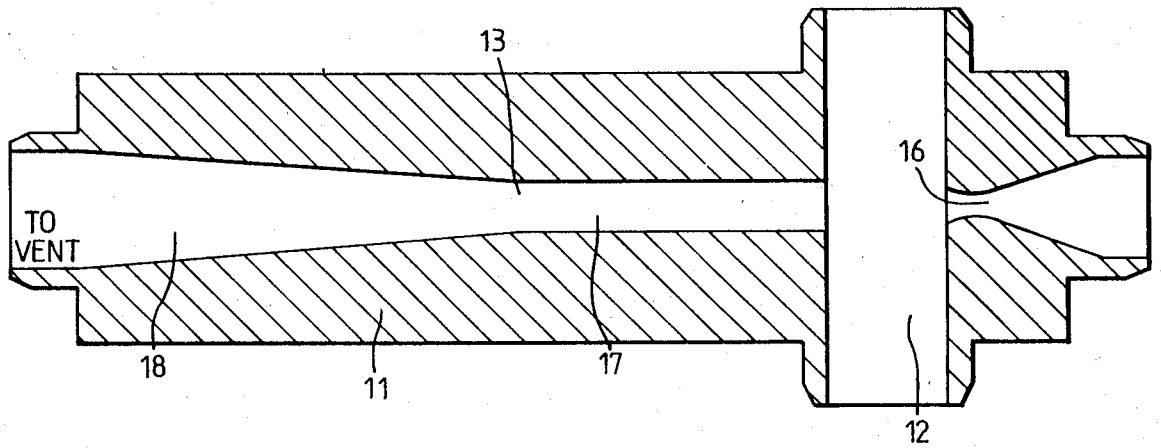
FIG. 2 is an embodiment of a control unit included in the pumping system.

With reference to FIG. 2, the primary controller 8 comprises a body 11 having a straight bore 12 of substantially uniform cross-section which is intersected by a bore 13. The bores 12 and 13 are not necessarily at right angles to one another. The bore 12 is connected at one end to the pipe 5 and at its opposite end to a conduit 14. The conduit 14 (FIG. 1) carries an ultrasonic transducer 15 and communicates with the solenoid valve 9.

The bore 13 comprises a jet nozzle 16 at one side of the bore 12 and a cylindrical mixing tube 17 terminating in a diffuser 18 at the opposite side of the bore 12. The diameter of the nozzle 16 and the mixing tube 17 is small compared to the diameter of the bore 12. Again with reference to FIG. 1, the nozzle 16 is connected by conduit 19 to the solenoid valve 10 and the diffuser 18 opens into a vent pipe 20 from the vessel 3.

The ultrasonic transducer 15 is so mounted on or side the conduit 14 that a signal generated by the transducer will travel along the conduit 14, through the bore 12 in the controller 8 and along the pipe 5 towards the charge vessel 4. With no liquid in the pipe 5 the signal reflected back to the transducer is altered in a characteristic manner, (there are changes in time, amplitude and phase). With liquid in the pipe 5, the signal is reflected back along the same path to the transducer 15. The ultrasonic transducer functions to determine the presence of liquid in the pipe 5 and acts as a switch. An associated electronic unit creates the signal and interprets the echos. An output from the electronic unit is supplied to a secondary controller which controls the operation of the solenoid valves 9 and 10.

The pumping system operates in the following manner. Initially, the valves 9 and 10 are closed and the charge vessel 4 is partially filled with liquid. On opening the valve 10 compressed air from the supply line 7 flows through the conduit 19 and is directed by the nozzle 16 across the bore 12 and into the mixing tube 17. From the mixing tube 17 the air is vented to atmosphere. The air issuing from the nozzle 16 creates a suction in the pipe 5. As a result, liquid 2 in the vessel 3 is drawn through the gap between the nozzles of the RFD 1 and into the charge vessel 4. The liquid level rises in the charge vessel to enter the end of the pipe 5. When the liquid enters the pipe 5 the ultrasonic signals produced by the transducer 15 and directed down the pipe 5 into the charge vessel 4 are reflected back along the pipe 5 to the transducer 15. The reflected ultrasonic signals are detected and generate an electrical signal input to an electronic control unit. The control unit functions to close the valve 10 and to open the valve 9 for a predetermined time interval, which can be 5 seconds. Compressed air can now pass along the pipe 14, the bore 12 in the primary controller 8 and the pipe 5 to pressurise the charge vessel 4. During this phase of operation the liquid in the charge vessel is urged across the RFD 1 and along the delivery pipe 6. A fraction of the compressed air supply will escape to vent 20 along the bore 13.

At the end of the predetermined time interval the control unit again functions to close the valve 9 and the valve 10 remains closed. The charge vessel is vented to atmosphere through line 5, bore 12 and 13. After a second predetermined time interval sufficient to allow the pressure in the charge vessel to fall to a pressure just above the pressure in the vent, generally atmospheric, the control unit again functions to open the valve 10 to initiate a further cycle of pumping operation.

Fluidic pumping systems have the advantage of utilising components which do not include moving parts which require maintenance or replacement. Such systems are favoured for pumping toxic and hazardous liquids such as radioactive effluent. In FIG. 1, the vessel 3 and the controller 8 are located behind a wall 21 of shielding material. The ultrasonic transducer 15 and the valves 9 and 10 can be located within secondary containment, such as a glovebox, positioned on the opposite side of the wall 21 and away from the radioactive or toxic region. The transducer and valves are thereby readily accessible. Further the compressed air supply path to the vessel 4 constituted by the pipe 14, the bore 12 in the controller 8 and the pipe 5 serves as a waveguide for the ultrasonic signals. It is not required to provide a separate path through the shielding wall 21 for the ultrasonic signals and this results in significant simplification of the system.

Another advantage is that the system is arranged such that liquid is not allowed to rise to any appreciable height in the pipe 5. The system can be such that the liquid level does not rise substantially beyond the junction of the pipe 5 with the vessel 4. As a result the bore of the pipe 5 remains dry and the vented air does not pick up liquid from the pipe.

Figure 3:
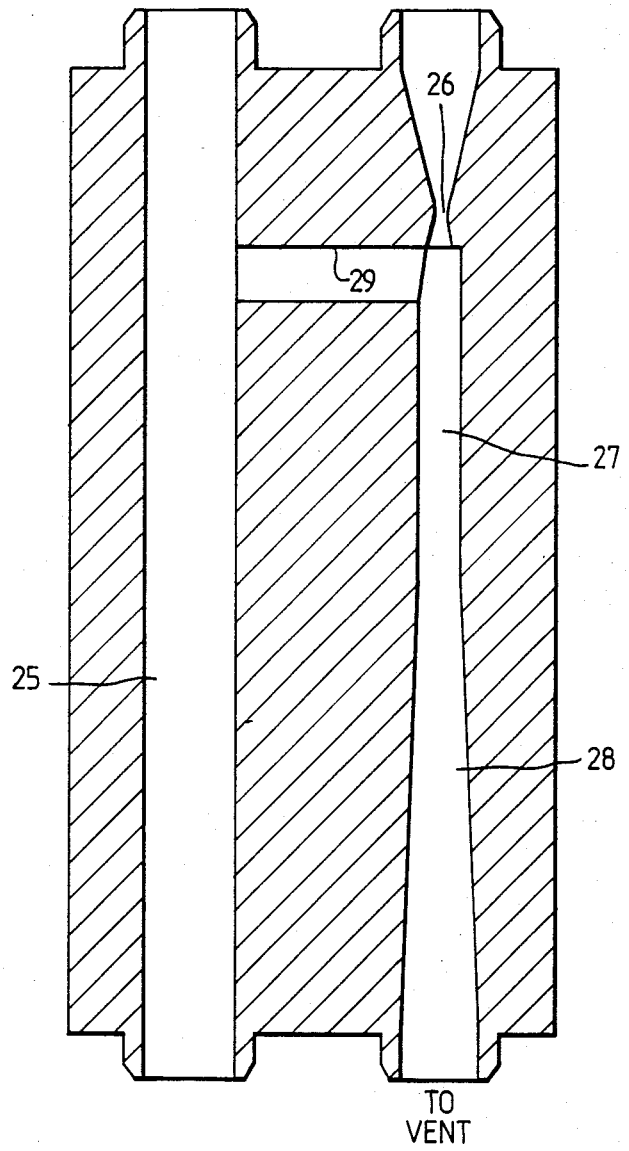
FIG. 3 is an alternative embodiment of a control unit.

FIG. 3 shows an alternative arrangement of a primary controller. In FIG. 3, the passage 25 corresponds to the bore 12 in the controller 8 of FIG. 2. Nozzle 26, mixing tube 27 and diffuser 28 corresponds to the respective parts 16, 17 and 18 in FIG. 2. At the junction of the nozzle 26 and the mixing tube 27 a branch passage 29 communicates with the passage 25. The controller shown in FIG. 3 is connected to the pipes 14, 19, 5 and vent in a manner identical to that shown in FIG. 2.

Figure 4:
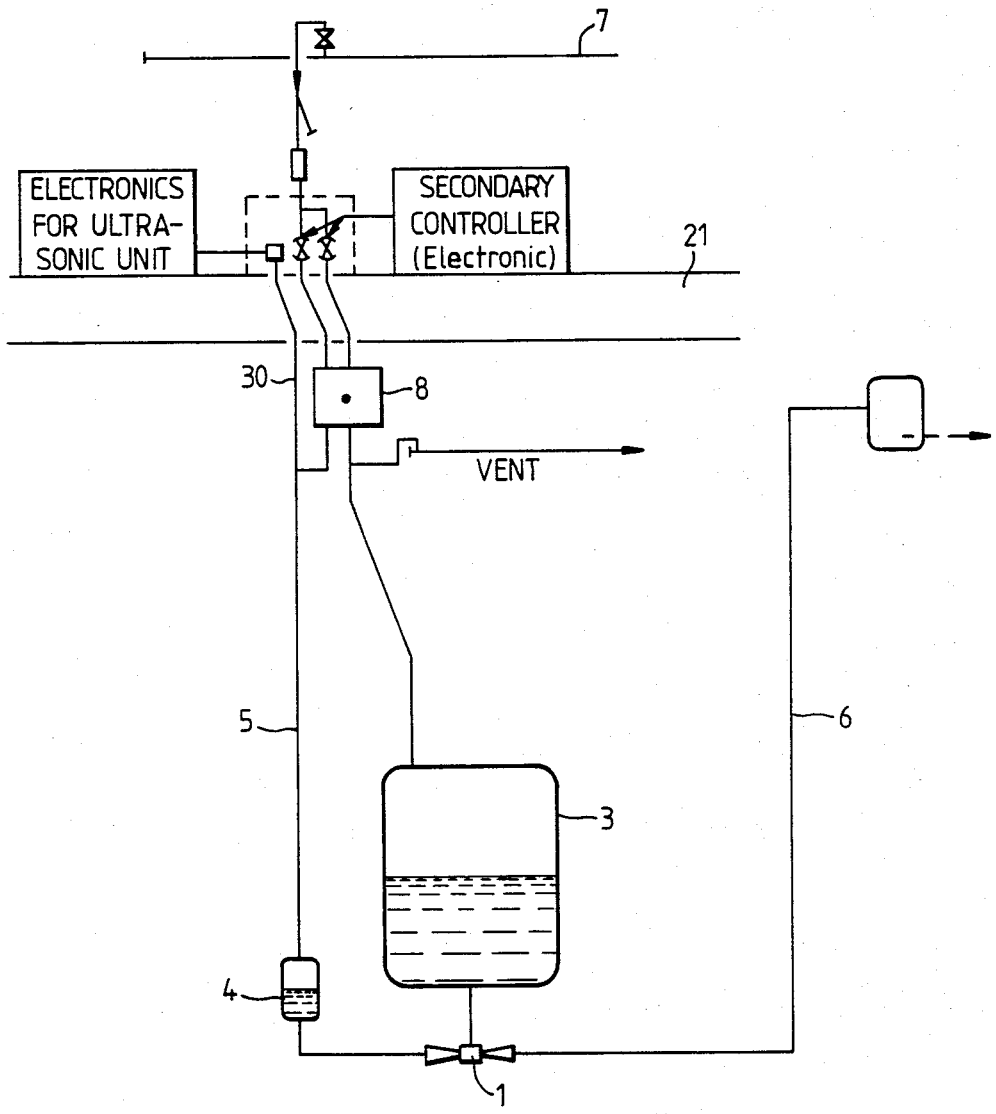
FIG. 4 is an alternative schematic arrangement of a pumping system.

A modified pumping system is shown in FIG. 4. In FIG. 4 the ultrasonic waveguide path by-passes the controller 8. Thus the pipe 5 is coupled to the transducer 15 by a pipe 30. The remaining reference numerals in FIG. 4 denote the same component parts as in FIG. 1. The modification enables the use of a number of different controllers but has the disadvantage of requiring an additional path through the shielding wall 21.

Figure 5:
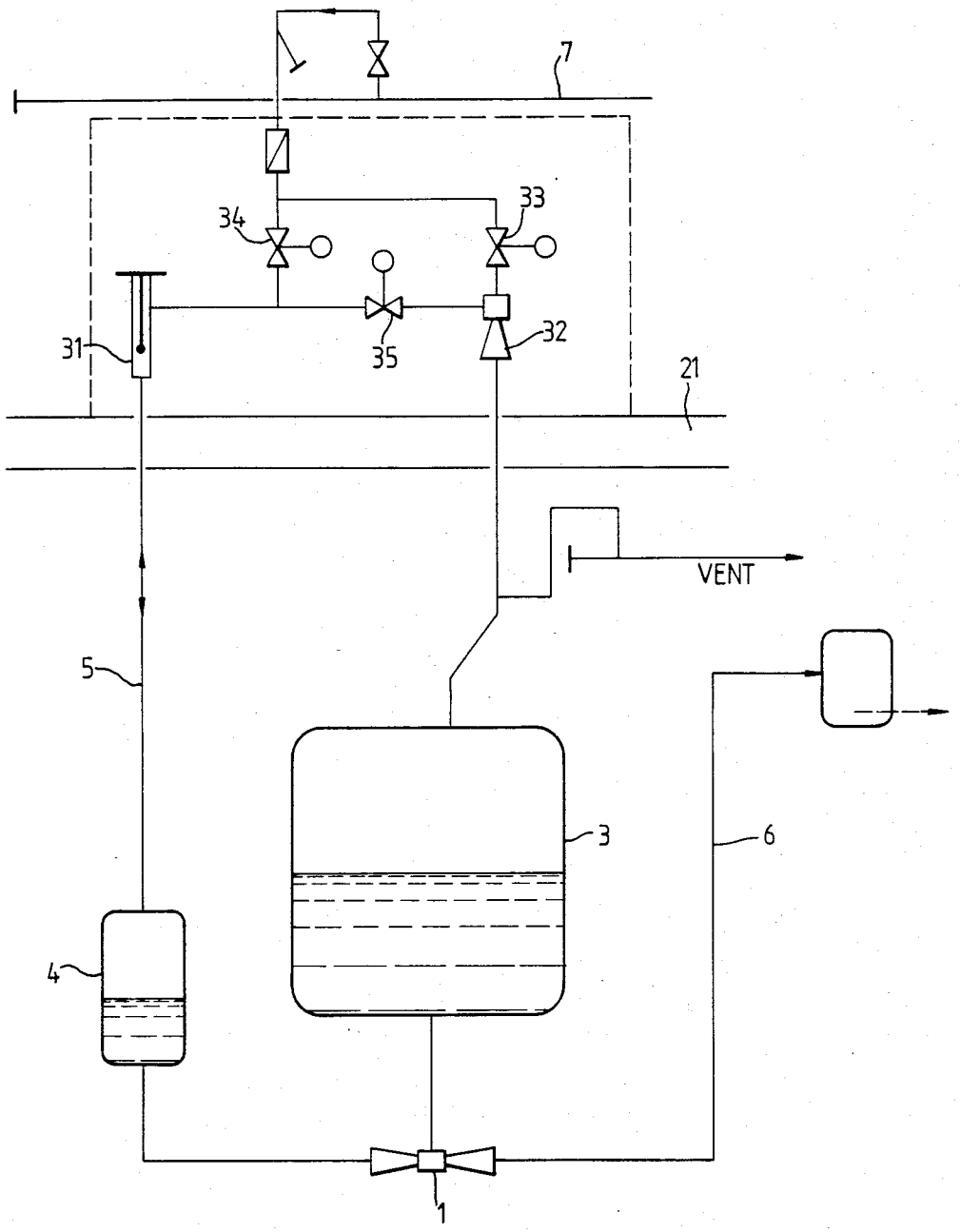
FIG. 5 is a further schematic embodiment of a pumping system.

A further embodient is shown in FIG. 5 in which a transducer 31, which can be an ultrasonic or sonic transducer, is arranged in the pipe 5. In this embodiment a combined nozzle and diffuser 32, similar to the nozzle 26 and diffuser 28 of FIG. 3 is connected to vent and the vessel 3. A valve assembly comprising valves 33, 34 and 35 is arranged as shown between the member 32, the transducer 31 and the compressed air supply 7. Initially, the valve 34 is closed with valves 33 and 35 open so that compressed air issuing from the nozzle of the member 32 into the diffuser creates a suction in the pipe 5 to fill the charge vessel 4. When the liquid level reaches the lower end of the pipe 5 the reflected signals from the transducer 31 cause the valves 33 and 35 to close and valve 34 to open for the predetermined time interval whereby compressed air from line 7 flows down pipe 5 to pressurise the charge vessel 4. At the end of the predetermined time interval the valve 34 closes and the valve 35 opens to vent the charge vessel to atmosphere. After a further predetermined time interval the valve 33 again opens to initiate a further cycle of pumping operation.

Although reference is made to the use of ultrasonics for initiating the pumping cycle it is possible to utilise sonic signals. Further, signals comprising electromagnetic radiation, for example, radio frequency, light or coherent light (laser) could be used. Although reference is made to a transducer being a combined transmitter and receiver it is possible to employ separate transducers to transmit and to receive the signals.

I claim:

1. A fluidic pumping system comprising a vessel for a liquid to be pumped, a reverse flow diverter positioned at a level below the level of the liquid to be pumped, a charge vessel and a delivery pipe with the reverse flow diverter inserted therebetween, compressed gas supply means for the charge vessel and control means for effecting alternate pressurising and venting of the charge vessel to effect pumping of the liquid, the control means including a conduit communicating with the charge vessel and means for generating signals along the conduit for detecting the liquid level at at least one position in the operating cycle.

2. A pumping system according to claim 1 in which the signal generating means comprises an ultrasonic transducer.

3. A pumping system according to claim 2 including valve means operable in response to the signals generated by the transducer for alternately pressurising and venting the charge vessel.

4. A pumping system according to claim 3 in which the transducer is mounted on a pipe communicating directly with the valve means.

* * * * *